US009029301B2

(12) United States Patent
Schleicher et al.

(10) Patent No.: US 9,029,301 B2
(45) Date of Patent: May 12, 2015

(54) SATURATION PROCESS FOR MAKING LUBRICANT BASE OILS

(71) Applicant: ExxonMobil Research & Engineering Company, Annandale, NJ (US)

(72) Inventors: Gary Paul Schleicher, Milford, NJ (US); Jason Thomas Calla, Fairfax, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 234 days.

(21) Appl. No.: 13/687,379

(22) Filed: Nov. 28, 2012

(65) Prior Publication Data

US 2013/0158314 A1 Jun. 20, 2013

Related U.S. Application Data

(60) Provisional application No. 61/576,118, filed on Dec. 15, 2011.

(51) Int. Cl.
*C10G 65/08* (2006.01)
*C10G 51/02* (2006.01)
(Continued)

(52) U.S. Cl.
CPC ..... *C10G 65/02* (2013.01); *C10G 51/02* (2013.01)

(58) Field of Classification Search
CPC ..... C10G 65/00; C10G 65/02; C10G 65/08; C10G 65/12
USPC ..... 208/58, 60, 142–145; 585/265–266
See application file for complete search history.

(56) References Cited

U.S. PATENT DOCUMENTS 5,098,684 A 3/1992 Kresge et al.
5,198,203 A 3/1993 Kresge et al.
(Continued)

FOREIGN PATENT DOCUMENTS

WO 2011097003 A2 8/2011
WO 2011143396 A2 11/2011

OTHER PUBLICATIONS

Speight, J.G. (1999). The Chemistry and Technology of Petroleum, 3rd ed, Marcel-Dekker, 918 pgs {Office action references Table 1-3 on p. 11).*
(Continued)

*Primary Examiner* — Brian McCaig
(74) *Attorney, Agent, or Firm* — Robert A. Migliorini

(57) ABSTRACT

Systems and methods are provided for hydroprocessing a petroleum fraction, such as a bottoms fraction from a fuels hydrocracking process, to generate a lubricant base oil. A fuels hydrocracking process typically has less stringent requirements for the sulfur and nitrogen content of a feed as compared to a lubricant base oil. Additionally, depending on the nature of the feed for the fuels hydrocracking process, the bottoms fraction may contain a relatively high level of aromatics compounds. The aromatic content of such a petroleum fraction can be reduced using a aromatic saturation stage with multiple catalyst beds, or alternatively using a reactor (or reactors) with multiple aromatic saturation stages. The catalysts in the various beds or stages can be selected to provide different types of aromatic saturation activity. An initial bed or stage can provide activity for saturation of 1-ring aromatics in the petroleum fraction. One or more subsequent beds or stages, operating at successively lower temperature, can then be used to reduce the multiple-ring aromatic content of the petroleum fraction.

9 Claims, 5 Drawing Sheets

(51) Int. Cl.

| | |
|---|---|
| *C10G 65/00* | (2006.01) |
| *C10G 65/02* | (2006.01) |
| *C10G 65/12* | (2006.01) |

(56) References Cited

U.S. PATENT DOCUMENTS

| | | | | |
|---|---|---|---|---|
| 7,029,571 | B1 * | 4/2006 | Bhattacharyya et al. | 208/76 |
| 2004/0065584 | A1 * | 4/2004 | Bishop et al. | 208/27 |
| 2008/0314797 | A1 * | 12/2008 | Sinclair et al. | 208/49 |
| 2009/0166251 | A1 | 7/2009 | Hantzer et al. | |
| 2010/0270205 | A1 * | 10/2010 | Lopez et al. | 208/17 |
| 2011/0282118 | A1 * | 11/2011 | Shih | 585/254 |

OTHER PUBLICATIONS

J. Amer. Chem. Soc., 1992, 114, 10834.

* cited by examiner

SATURATION PROCESS FOR MAKING LUBRICANT BASE OILS

CROSS-REFERENCE TO RELATED APPLICATIONS

This application claims the benefit of U.S. Provisional Application Ser. No. 61/576,118, filed on Dec. 15, 2011; which is incorporated herein in its entirety by reference.

FIELD

This disclosure provides systems and method for hydroprocessing of lubricant base oil boiling range feeds.

BACKGROUND

One of the goals in processing of petroleum fractions is to find a high value use for as much of a petroleum fraction as possible. Even if a process converts a large percentage of a feed into a desired product, if the residual portion of the feed cannot be used in a secondary product, the overall process may not be profitable. For example, hydrocracking of hydrocarbon feedstocks is often used to convert lower value hydrocarbon fractions into higher value products, such as conversion of vacuum gas oil (VGO) feedstocks to various fuels and lubricants. A typical fuels hydrocracking process will also generate a portion of unconverted feed. For a typical fuels hydrocracking process to be profitable for a refinery, a beneficial use needs to be identified for this unconverted feed portion.

SUMMARY

Systems and methods are provided for hydroprocessing a petroleum fraction, such as a bottoms fraction from a fuels hydrocracking process, to generate a lubricant base oil. A fuels hydrocracking process typically has less stringent requirements for the sulfur and nitrogen content of a feed as compared to a lubricant base oil. Additionally, depending on the nature of the feed for the fuels hydrocracking process, the bottoms fraction may contain a relatively high level of aromatics compounds. The aromatic content of such a petroleum fraction can be reduced using an aromatic saturation stage with multiple catalyst beds, or alternatively using a reactor (or reactors) with multiple aromatic saturation stages. The catalysts in the various beds or stages can be selected to provide different types of aromatic saturation activity. An initial bed or stage can provide activity for saturation of 1-ring aromatics in the petroleum fraction. One or more subsequent beds or stages, operating at successively lower temperature, can then be used to reduce the multiple-ring aromatic content of the petroleum fraction.

DETAILED DESCRIPTION

Figure 1:
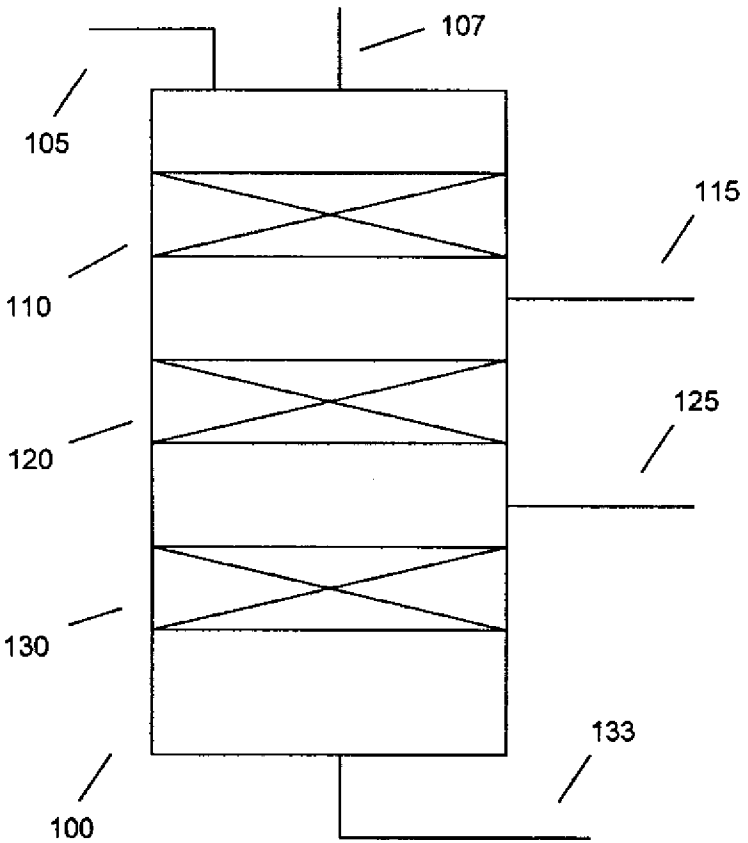
FIG. 1 schematically shows a reactor suitable for performing an aromatic saturation process according to the disclosure.

All numerical values within the detailed description and the claims herein are modified by "about" or "approximately" the indicated value, and take into account experimental error and variations that would be expected by a person having ordinary skill in the art.

Overview

In various embodiments, systems and methods are provided for hydroprocessing a petroleum fraction, such as a bottoms fraction from a fuels hydrocracking process, to generate a lubricant base oil. A fuels hydrocracking process typically has less stringent requirements for the sulfur and nitrogen content of a feed as compared to a lubricant base oil. Additionally, depending on the nature of the feed for the fuels hydrocracking process, the bottoms fraction may contain a relatively high level of aromatics compounds. Various regulations restrict the quantity and type of aromatic compounds that can be present in lubricant base oils. In order to use such a petroleum fraction as a lubricant base oil, the aromatic content needs to be reduced to levels that match the specifications and/or regulatory requirements for the desired type of lubricant base oil.

The aromatic content of such a petroleum fraction can be reduced using a aromatic saturation stage with multiple catalyst beds, or alternatively using a reactor (or reactors) with multiple aromatic saturation stages. The catalysts in the various beds or stages can be selected to provide different types of aromatic saturation activity. An initial bed or stage can provide activity for saturation of 1-ring aromatics in the petroleum fraction. One or more subsequent beds or stages, operating at successively lower temperature, can then be used to reduce the multiple-ring aromatic content of the petroleum fraction. The pressure can be selected to provide a desired type of lubricant base oil, with lower pressures being suitable for production of Group I type lubricant base oils and higher pressures being suitable for production of Group II type lubricant base oils.

Input Feed for Aromatic Saturation Stages

In some embodiments, an input feed according to the disclosure can be a bottoms cut from a fuels hydrocracking process, or another input feed with suitable characteristics. In other embodiments, an input feed according to the disclosure can be a bottoms cut from a hydrocracking process for forming a lubricant base oil, or another input feed with suitable characteristics.

Preferably, feeds with sulfur contents of less than 300 wppm can be used. For example, a typical bottoms fraction from a lubricant base oil production process will have a sulfur content of 10 wppm or less, along with a nitrogen content of 1 wppm or less. A typical bottoms fraction from a fuels hydrocracking process will have a sulfur content of 100 wppm or less, along with a nitrogen content of 10 wppm or less. In an alternative embodiment, a feed with up to 500 wppm of sulfur could be used. In such an alternative situation, the type of sulfur in the feed would need to be sulfur that could be removed during the aromatic saturation process to a level of 300 wppm or less.

Suitable input feeds for aromatic saturation will typically be feeds that contain various types of single ring and multi-ring aromatics. The total aromatics content of a suitable feed can be at least 200 mmol/kg (equivalent to μmol/g), such as at least 600 mmol/kg, or at least 1000 mmol/kg, or at least 2000 mmol/kg. The amount of multi-ring aromatics can be at least 50 mmol/kg, or at least 100 mmol/kg, or at least 200 mmol/kg.

Other options are also available for characterizing the aromatic content of a sample. One option is the mutagenicity index of an input feed. Mutagenicity index is a value measured using an ASTM approved procedure called the modified Ames assay. In some situations, mutagenicity index can also be estimated or calculated based on correlations with compounds detected in a sample. The mutagenicity index of an input feed can be at least 0.4, or at least 1.0. A potential goal of the aromatic saturation processing according to the disclosure is to reduce the mutagenicity index of an input feed to 1.0 or less, or preferably to 0.4 or less. Of course, a feed with a mutagenicity index of less than 0.4 can also be processed according to the disclosure to achieve still lower values of mutagenicity index. Lower values of mutagenicity index can be beneficial so that random processing variations during commercial scale production do not result in a sample with an undesirable mutagenicity index value.

As an alternative to performing a modified Ames assay, the mutagenicity index for a sample can be estimated by measuring the absorptivity of the sample at 325 nm. Table 1 shows an example of mutagenicity index values generated using a modified Ames assay versus measurements of the ultraviolet absorption for the same samples at 325 nm.

TABLE 1

| Absorptivity at 325 nm | Mutagenicity index |
|---|---|
| 0.014 | 0.1 |
| 0.018 | 0.1 |
| 0.03 | 0.2 |
| 0.018 | 0.3 |
| 0.028 | 0.3 |
| 0.044 | 0.7 |
| 0.037 | 0.2 |
| 0.158 | 1.2 |
| 0.227 | 1.8 |

As shown in Table 1, while the data is somewhat noisy, there is a rough correlation between the absorptivity at 325 nm and the mutagenicity index of a sample. Based on a linear data fit, each 0.1 increase in absorptivity at 325 nm corresponds to 0.75 increase in mutagenicity index. In some of the results below, the absorptivity at 325 nm for samples will be used to estimate the mutagenicity index.

Another option for characterizing the multi-ring aromatic content of an input feed is the gravimetric test referred to as IP-346. IP-346 is a standardized test that determines a weight percent of compounds that are extracted using a solvent, such as dimethyl sulfoxide (DMSO). Although IP-346 is a test designed to measure a property of a sample that is somewhat similar to mutagenicity index, the results of an IP-346 measurement do not correspond to a mutagenicity index measurement in a straightforward manner. In Europe, substances with an IP-346 value of greater than 3 wt % may be required to have a label indicating that the substance is "toxic". Thus, another potential goal of an aromatic saturation process is to process an input feed with an IP-346 value greater than 3.0 wt % to generate a product with an IP-346 value less than 3.0 wt %. Preferably, in such embodiments the IP-346 value of the product can be 1.5 wt % or less, or 1.0 wt % or less. Lower IP-346 values can be beneficial so that random processing variations during commercial scale production do not result in a sample with an undesirable IP-346 value.

In embodiments where the product of an aromatic saturation process will be a lubricant base oil, the input feed should also have suitable lubricant base oil properties. For example, an input feed intended for use as a Group I or Group II base oil can have a viscosity index (VI) of at least 80, preferably at least 90 or at least 95. An input feed intended for use as a Group I+ base oil can have a VI of at least 100, while an input feed intended for use as a Group II+ base oil can have a VI of at least 110. The viscosity of the input feed can be at least 2 cSt at 100° C., or at least 4 cSt at 100° C., or at least 6 cSt at 100° C.

Feedstocks for General Hydroprocessing

Typically, an input feed for an aromatic saturation process according to the disclosure will be generated as a product or side-product from a previous type of hydroprocessing, such as hydrocracking for fuels or lubricant base stock production. A wide range of petroleum and chemical feedstocks can be hydroprocessed. Suitable feedstocks include whole and reduced petroleum crudes, atmospheric and vacuum residua, propane deasphalted residua, e.g., brightstock, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials.

One way of defining a feedstock is based on the boiling range of the feed. One option for defining a boiling range is to use an initial boiling point for a feed and/or a final boiling point for a feed. Another option, which in some instances may provide a more representative description of a feed, is to characterize a feed based on the amount of the feed that boils at one or more temperatures. For example, a "T5" boiling point for a feed is defined as the temperature at which 5 wt % of the feed will boil off. Similarly, a "T95" boiling point is a temperature at 95 wt % of the feed will boil.

Typical feeds include, for example, feeds with an initial boiling point of at least 650° F. (343° C.), or at least 700° F. (371° C.), or at least 750° F. (399° C.). Alternatively, a feed may be characterized using a T5 boiling point, such as a feed with a T5 boiling point of at least 650° F. (343° C.), or at least 700° F. (371° C.), or at least 750° F. (399° C.). Typical feeds include, for example, feeds with a final boiling point of 1150° F. (621° C.), or 1100° F. (593° C.) or less, or 1050° F. (566° C.) or less. Alternatively, a feed may be characterized using a T95 boiling point, such as a feed with a T95 boiling point of 1150° F. (621° C.), or 1100° F. (593° C.) or less, or 1050° F. (566° C.) or less. It is noted that feeds with still lower initial boiling points and/or T5 boiling points may also be suitable, so long as sufficient higher boiling material is available so that a bottoms fraction (or other fraction) is generated that can undergo aromatic saturation according to the disclosure to produce a lubricant base stock.

The sulfur content of a feed to a hydroprocessing reaction can be at least 100 ppm by weight of sulfur, or at least 1000 wppm, or at least 2000 wppm, or at least 4000 wppm, or at least 10,000 wppm, or at least 20,000 wppm. The sulfur content can be 2000 wppm or less, or 1000 wppm or less, or 500 wppm or less, or 100 wppm or less. The amount of sulfur present before hydroprocessing can depend on the type and nature of the feed, as well as potentially other processing that the feed has been exposed to.

In some embodiments, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this disclosure include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil.

Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used in accordance with the disclosure include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesnmus dimorphus, Euglena gracilis, Phaeodactylum tricornutum, Pleurochrysis carterae, Prymnesium parvum, Tetrasehnis chui*, and *Chlamydomonas reinhardtii*.

The biocomponent feeds usable in the present disclosure can include any of those which comprise primarily triglycerides and free fatty acids (FFAs). The triglycerides and FFAs typically contain aliphatic hydrocarbon chains in their structure having from 8 to 36 carbons, preferably from 10 to 26 carbons, for example from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority (i.e., greater than 50%) of the triglyceride present in the lipid material can be comprised of $C_{10}$ to $C_{26}$, for example $C_{12}$ to $C_{18}$, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

Biocomponent based feedstreams typically have relatively low nitrogen and sulfur contents. For example, a biocomponent based feedstream can contain up to 500 wppm nitrogen, for example up to 300 wppm nitrogen or up to 100 wppm nitrogen. Instead of nitrogen and/or sulfur, the primary heteroatom component in biocomponent feeds is oxygen. Biocomponent diesel boiling range feedstreams, e.g., can include up to 10 wt % oxygen, up to 12 wt % oxygen, or up to 14 wt % oxygen. Suitable biocomponent diesel boiling range feedstreams, prior to hydrotreatment, can include at least 5 wt % oxygen, for example at least 8 wt % oxygen.

Alternatively, a feed of biocomponent origin can be used that has been previously hydrotreated. This can be a hydrotreated vegetable oil feed, a hydrotreated fatty acid alkyl ester feed, or another type of hydrotreated biocomponent feed. A hydrotreated biocomponent feed can be a biocomponent feed that has been previously hydroprocessed to reduce the oxygen content of the feed to 500 wppm or less, for example to 200 wppm or less or to 100 wppm or less. Correspondingly, a biocomponent feed can be hydrotreated to reduce the oxygen content of the feed, prior to other optional hydroprocessing, to 500 wppm or less, for example to 200 wppm or less or to 100 wppm or less. Additionally or alternately, a biocomponent feed can be blended with a mineral feed, so that the blended feed can be tailored to have an oxygen content of 500 wppm or less, for example 200 wppm or less or 100 wppm or less. In embodiments where at least a portion of the feed is of a biocomponent origin, that portion can be at least 2 wt %, for example at least 5 wt %, at least 10 wt %, at least 20 wt %, at least 25 wt %, at least 35 wt %, at least 50 wt %, at least 60 wt %, or at least 75 wt %. Additionally or alternately, the biocomponent portion can be 75 wt % or less, for example 60 wt % or less, 50 wt % or less, 35 wt % or less, 25 wt % or less, 20 wt % or less, 10 wt % or less, or 5 wt % or less.

The content of sulfur, nitrogen, and oxygen in a feedstock created by blending two or more feedstocks can typically be determined using a weighted average based on the blended feeds. For example, a mineral feed and a biocomponent feed can be blended in a ratio of 80 wt % mineral feed and 20 wt % biocomponent feed. In such a scenario, if the mineral feed has a sulfur content of 1000 wppm, and the biocomponent feed has a sulfur content of 10 wppm, the resulting blended feed could be expected to have a sulfur content of 802 wppm.

Aromatic Saturation Process Conditions

In various embodiments, an aromatic saturation process can include multiple beds and/or stages of catalyst. An input feed is exposed to the multiple beds or stages of catalyst under conditions effective for reducing the aromatics content of the input feed. The effective conditions include lower processing temperatures as the input feed passes through the beds or stages. The multiple beds or stages can be organized in a single reactor or in a plurality of reactors. For convenience in describing concepts related to the disclosure, the following discussion will describe an embodiment where the aromatic saturation process is performed in a reactor containing multiple catalyst beds, with a different catalyst bed for each processing temperature. However, other embodiments can include multiple beds at a given temperature, or multiple catalysts in a catalyst bed, or other convenient arrangements of catalyst.

One of the difficulties in saturating aromatics in an input feed is the different reaction mechanisms involved. Some aromatics, such as single ring aromatics and two ring aromatics, are saturated more effectively as the severity of the reaction conditions is increased. For these types of aromatics, increasing the reaction temperature or the partial pressure of hydrogen will lead to increased saturation of the aromatic molecules. Thus, for aromatics similar to typical single ring aromatics, increased temperatures and/or hydrogen partial pressures leads to reduced levels of aromatics in a product.

Other aromatics, such as some multi-ring aromatics having three or more rings, have a different saturation mechanism. For these aromatics, the reaction conditions during a typical aromatic saturation process lead to a situation where both non-aromatic and aromatic species are in equilibrium. As the temperature in the process conditions increases, the aromatic species in the equilibrium are increasingly favored. As a result, temperatures that lead to increase reduction of single ring aromatic species can also lead to increased formation of multi-ring aromatic species.

An additional consideration during aromatic saturation is catalyst acidity. Many types of catalysts that perform aromatic saturation, such as hydrocracking catalysts, also have high acidity. At temperatures suitable for saturating single ring aromatics, an acidic catalyst will typically also facilitate cracking of molecules in a feed, resulting in conversion of lubricant base oil boiling range molecules to lower boiling molecules.

In order to address the above problems, an aromatic saturation process is provided that includes multiple catalyst beds and processing temperatures. Earlier beds in the aromatic saturation process can be used to saturate single ring aromatic molecules while reducing or mitigating the number of multi-ring aromatics that are formed. Subsequent catalyst beds are used with lower processing temperatures to saturate the multi-ring aromatics. In addition to temperature, the partial pressure of hydrogen in the reaction beds or stages can impact the nature of the products.

In an embodiment, a first catalyst bed can include a catalyst for saturation of single ring aromatics. The catalyst for the first catalyst bed is low in acidity to reduce or avoid cracking of the input feed at the temperatures needed for effective saturation of single ring aromatics. Cracking of the input feed can result in loss of lubricant base oil yield as well as loss of viscosity in the resulting lubricant base oil. Preferably, the catalyst for the first catalyst bed also has sufficient reactivity to provide a long catalyst lifetime between catalyst change events.

One option for a catalyst in the first bed is a hydrotreating catalyst that includes Pt, Pd, or a combination thereof on a non-acidic support such as alumina or titania. This includes conventional hydrotreating catalysts with Pt or Pd supported on alumina. The catalyst can include from 0.1 wt % to 5.0 wt % of hydrogenation metal relative to the weight of the support. This type of catalyst can be used in the first catalyst bed at temperatures between 330° C. to 360° C. Due to the low acidity support, this type of catalyst causes little or no cracking of feed while being effective for reduction of single ring aromatics. However, this type of catalyst tends to deactivate rapidly, resulting in frequent reactor shut down operations to allow for catalyst skimming and/or change out.

Another option for the first catalyst bed is to use a dewaxing catalyst that includes a hydrogenation metal and a zeolite or molecular sieve that operates primarily by isomerization. Examples of hydrogenation metals include Group VIII noble metals or combinations of Group VIII noble metals, with Pt being preferred. The amount of hydrogenation metal relative to the weight of the catalyst can be from 0.1 wt % to 5.0 wt %, preferably from 0.3 wt % to 1.5 wt %, such as 0.6 wt % or 0.9 wt %. Examples of zeolites or molecular sieves that operate primarily by isomerization include ZSM-48, ZSM-23, and ZSM-35 (ferrierite). Catalysts with similar structures can also be used, such as EU-2, EU-11, ZBM-30, or SSZ-32. Such a catalyst can include a low acidity binder, such as alumina, titania, or zirconia. The weight of zeolite or molecular sieve relative to weight of binder can be from 80:20 to 20:80, such as 65% zeolite to 35% binder. In some preferred embodiments, the ratio of zeolite or molecular sieve to binder can be 55:45 or less, or 50:50 or less, or 40:60 or less. This type of catalyst can be used in the first catalyst bed at a temperature from 300° C. to 330° C.

Another consideration during the reaction is the partial pressure of hydrogen. At lower partial pressures of hydrogen, such as from 1.8 MPag (250 psig) to 4.1 MPag (600 psig), the reaction conditions will be more likely to result in production of a Group I type lubricant base oil. At partial pressures from 4.1 MPag (600 psig) to 6.9 MPag (1000 psig), the reaction conditions will be more likely to result in production of a Group II type base oil. This is due to the requirement that a Group II base oil must have a sulfur content below 300 wppm and contain more than 90 wt % saturates. As the partial pressure of hydrogen during the reaction is increased, the likelihood of achieving at least 90 wt % of saturates also increases. For example, a process intended for making a Group I base oil could use a hydrogen partial pressure of 2.4 MPag (350 psig) to 3.4 MPag (500 psig), such as 2.8 MPag (400 psig). A process intended for making a Group II base oil could use a hydrogen partial pressure of 5.2 MPag (750 psig) to 6.9 MPag (1000 psig), such as 5.5 MPag (800 psig).

Process conditions other than temperature and pressure for the reactor containing the first catalyst bed can include a liquid hourly space velocity of from 0.2 $hr^{-1}$ to 10 $hr^{-1}$, preferably 0.5 $hr^{-1}$ to 3.0 $hr^{-1}$, and a hydrogen circulation rate of from 35.6 $m^3/m^3$ to 1781 $m^3/m^3$ (200 scf/B to 10,000 scf/B), preferably 178 $m^3/m^3$ to 890.6 $m^3/m^3$ (1000 scf/B to 5000 scf/B). In still other embodiments, the hydrogen treat gas rates of from 213 $m^3/m^3$ to 1068 $m^3/m^3$ (1200 SCF/B to 6000 SCF/B).

With regard to treat gas rates, one of the factors that can influence a treat gas rate is the amount of hydrogen used in a quench stream between catalyst beds or stages. In order to achieve a desired temperature in each catalyst bed or stage, a quench stream can be used between the stages to reduce the temperature. Any convenient gas quench stream can be used, such as a hydrogen stream, a nitrogen stream, another type of gas stream that is inert relative to the conditions in the reactor, or a combination thereof. Although it is not as preferred, a liquid quench stream of an appropriate type could also be used.

The quench stream can be used to cool the output flow from the first catalyst bed prior to contacting the second catalyst bed. The second catalyst bed can operate at a reduced temperature relative to the first catalyst bed, such as from 270° C. to 300° C. The temperature differential between the inlet or top of the first catalyst bed/stage and the inlet/top of the second catalyst bed/stage can be at least 25° C., or at least 30° C., or at least 35° C., or at least 40° C. Additionally or alternately, the temperature at the inlet/top of the second bed/stage can be at least 20° C. lower than the temperature at the outlet of the first bed/stage, for example at least 25° C. lower, at least 30° C. lower, at least 35° C. lower, at least 40° C. lower, at least 45° C. lower, or at least 50° C. lower. The hydrogen partial pressure, space velocity, and hydrogen treat gas rate values for the second catalyst bed can all be similar to the ranges for the first catalyst bed.

The catalyst in the second catalyst bed can be similar to the catalyst for the first catalyst bed, or a different type of catalyst can be selected. A dewaxing catalyst that operates primarily by isomerization, such as the catalysts described for the first catalyst bed, is an appropriate choice for the second catalyst bed as well. Alternatively, a catalyst based on the M41S family of catalyst supports can be selected, such as MCM-41, MCM-48, or MCM-50. Catalysts based on the M41S family of catalyst supports tend to have higher acidity values, and therefore are not as suitable for use in the first catalyst bed. However, at the lower reaction temperature used for the second catalyst bed, the potential for cracking of the feed is reduced, making this type of catalyst suitable for the second catalyst bed.

In an embodiment, an aromatic saturation (hydrofinishing) catalyst can comprise, consist essentially of, or be a Group VIII and/or Group VIB metal on a support material, e.g., an amorphous support such as a bound support from the M41S family, for instance bound MCM-41. In some cases, certain hydrotreatment catalysts (as described below) can also be used as aromatic saturation catalysts. The M41S family of catalysts can be described as mesoporous materials having relatively high silica contents, e.g., whose preparation is further described in *J. Amer. Chem. Soc.,* 1992, 114, 10834. Examples of M41S materials can include, but are not limited to MCM-41, MCM-48, MCM-50, and combinations thereof. Mesoporous is understood to refer to catalysts having pore sizes from 15 Angstroms to 100 Angstroms. A preferred member of this class is MCM-41, whose preparation is described, e.g., in U.S. Pat. No. 5,098,684. MCM-41 is an inorganic, porous, non-layered phase having a hexagonal arrangement of uniformly-sized pores. The physical structure of MCM-41 is similar to a bundle of straws, in which the opening of the straws (the cell diameter of the pores) ranges from 15-100 Angstroms. MCM-48 has a cubic symmetry and is described, for example, in U.S. Pat. No. 5,198,203. MCM-50 has a lamellar structure.

MCM-41 can be made with different size pore openings in the mesoporous range. Preferably, an MCM-41 catalyst can have an average pore size of 40 angstroms or less, such as 25 angstroms or less. The content of framework molecules in an MCM-41 catalyst can also vary. The framework of the MCM-41 can include silica, in combination with alumina, titania, or zirconia. The ratio of silica to alumina, titania, or zirconia in the framework can vary from as high as 800:1 to as little as 25:1.

If binders are desired to be used, suitable binders for the M41S family, and specifically for MCM-41, can include alumina, silica, titania, silica-aluminas, or a combination thereof. With some types of binders, relatively high specific surface areas are possible with MCM-41 type catalysts, such as catalyst surface areas of at least 600 $m^2/g$, at least 750 $m^2/g$, at least 850 $m^2/g$, or at least 950 $m^2/g$. Preferably, binders providing a lower surface area can be selected, such as binders that provide a catalyst surface area of 650 $m^2/g$ or less, or 550 $m^2/g$ or less. Low surface area alumina or titania binders are options for producing a MCM-41 type catalyst with a reduced surface area.

One example of a suitable aromatic saturation catalyst is an alumina-bound mesoporous MCM-41 with a supported hydrogenation metal thereon/therein, e.g., Pt, Pd, another Group VIII metal, a Group VIB metal, or a mixture thereof. Individual hydrogenation metal embodiments can include, but are not limited to, Pt only or Pd only, while mixed hydrogenation metal embodiments can include, but are not limited to, combinations of Pt and Pd. When present, the amount of Group VIII hydrogenation metal(s) can be at least 0.1 wt % based on the total weight of the catalyst, for example at least 0.5 wt % or at least 0.6 wt %. Additionally or alternately, the amount of Group VIII hydrogenation metal(s) can be 5.0 wt % or less based on the total weight of the catalyst, for example 3.5 wt % or less, 2.5 wt % or less, 1.5 wt % or less, 1.0 wt % or less, 0.9 wt % or less, 0.75 wt % or less, or 0.6 wt % or less. Further additionally or alternately, the total amount of hydrogenation metal(s) can be at least 0.1 wt % based on the total weight of the catalyst, for example at least 0.25 wt %, at least 0.5 wt %, at least 0.6 wt %, at least 0.75 wt %, or at least 1 wt %. Still further additionally or alternately, the total amount of hydrogenation metal(s) can be 35 wt % or less based on the total weight of the catalyst, for example 30 wt % or less, 25 wt % or less, 20 wt % or less, 15 wt % or less, 10 wt % or less, or 5 wt % or less.

After the second catalyst bed, another quench stream can be used to cool the output flow from the second catalyst bed prior to contacting the third catalyst bed. The second catalyst bed can operate at a reduced temperature relative to the second catalyst bed, such as from 225° C. to 250° C. The temperature differential between the inlet or top of the first catalyst bed/stage and the inlet/top of the second catalyst bed/stage can be at least 25° C., or at least 30° C., or at least 35° C., or at least 40° C. Additionally or alternately, the temperature at the inlet/top of the second bed/stage can be at least 20° C. lower than the temperature at the outlet of the first bed/stage, for example at least 25° C. lower, at least 30° C. lower, at least 35° C. lower, at least 40° C. lower, at least 45° C. lower, or at least 50° C. lower. The hydrogen partial pressure, space velocity, and hydrogen treat gas rate values for the second catalyst bed can all be similar to the ranges for the first catalyst bed.

The catalyst used in the third catalyst bed can be an M41S type catalyst, such as an MCM-41 type catalyst as described above. If an MCM-41 type catalyst is used in the second catalyst bed, the MCM-41 catalyst in the third bed can be the same or different. As an example, the catalyst in the second bed can be an MCM-41 catalyst with titania in the framework, a silica to titania ratio of from 25:1 to 80:1, and bound with a low surface area alumina or titania binder. In such an example, the catalyst in the third bed can be an MCM-41 catalyst with alumina in the framework, a silica to alumina ratio of from 25:1 to 80:1, and bound with a binder providing a surface area of at least 600 $m^2/g$. In this type of example, the catalysts in both the second bed and the third bed can include from 0.1 to 1.5 wt % of Pt, or alternatively from 0.1 to 0.5 wt % Pt in combination with 0.5 to 1.0 wt % Pd.

Hydroprocessing for Fuels Production

One source of input feed for an aromatic saturation process as described above is to use the bottoms from a fuels hydrocracking process as the input feed. In a fuels hydrocracking process, a feed that has at least a portion boiling above the diesel range is hydrocracked to convert higher boiling molecules to molecules boiling in the diesel or naphtha boiling range. A typical fuels hydrocracking process may also include a preliminary hydrotreating stage. When either hydrotreating or hydrocracking is used for substantial sulfur removal, a gas-liquid separator may be used to remove gas phase contaminants from the remaining liquid effluent.

Although fuels hydrocracking is provided as an exemplary process, other types of processes may produce a fraction that is suitable as an input feed. In addition to hydrotreating and hydrocracking processes, a dewaxing process could also be used as part of the generation of a suitable input feed.

Hydrotreatment is typically used to reduce the sulfur, nitrogen, and aromatic content of a feed. Hydrotreating conditions can include temperatures of 200° C. to 450° C., or 315° C. to 425° C.; pressures of 250 psig (1.8 MPa) to 5000 psig (34.6 MPa) or 300 psig (2.1 MPa) to 3000 psig (20.8 MPa); Liquid Hourly Space Velocities (LHSV) of 0.2-10 $h^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreating catalysts are typically those containing Group VIB metals, such as molybdenum and/or tungsten, and non-noble Group VIII metals, such as, iron, cobalt and nickel and mixtures thereof. These metals or mixtures of metals are typically present as oxides or sulfides on refractory metal oxide supports. Suitable metal oxide supports include low acidic oxides such as silica, alumina or titania. Preferred aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support. Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina. Alternatively, the hydrotreating catalyst can be a bulk metal catalyst, or a combination of stacked beds of supported and bulk metal catalyst.

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

In various embodiments, the conditions selected for hydrocracking for lubricant base stock production can depend on the desired level of conversion, the level of contaminants in the input feed to the hydrocracking stage, and potentially other factors. A hydrocracking process performed under sour conditions, such as conditions where the sulfur content of the input feed to the hydrocracking stage is at least 500 wppm, can be carried out at temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 500 psig to 3000 psig (3.5 MPag-20.9 MPag), liquid hourly space velocities of from 0.2 $h^{-1}$ to 2 h and hydrogen treat gas rates of from 213 $m^3/m^3$ to 1068 $m^3/m^3$ (1200 SCF/B to 6000 SCF/B).

A hydrocracking process performed under non-sour conditions can be performed under conditions similar to those used for a first stage hydrocracking process, or the conditions can be different. Alternatively, a non-sour hydrocracking stage can have less severe conditions than a similar hydrocracking stage operating under sour conditions. Suitable hydrocracking conditions can include temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 500 psig to 3000 psig (3.5 MPag-20.9 MPag), liquid hourly space velocities of from 0.2 $h^{-1}$ to 2 $h^{-1}$ and hydrogen treat gas rates of from 213 $m^3/m^3$ to 1068 $m^3/m^3$ (1200 SCF/B to 6000 SCF/B). In some embodiments, multiple hydrocracking stages may be present, with a first hydrocracking stage operating under sour conditions, while a second hydrocracking stage operates under non-sour conditions and/or under conditions where the sulfur level is substantially reduced relative to the first hydrocracking stage. In such embodiments, the temperature in the second stage hydrocracking process can be 40° F. (22° C.) less than the temperature for a hydrocracking process in the first stage, or 80° F. (44° C.) less, or 120° F. (66° C.) less. The pressure for the second stage hydrocracking process can be 100 psig (690 kPa) less than a hydrocracking process in the first stage, or 200 psig (1380 kPa) less, or 300 psig (2070 kPa) less.

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In some embodiments, a dewaxing catalyst is also included as part of the process train that generates the input feed. Typically, the dewaxing catalyst is located in a bed downstream from any hydrocracking catalyst stages and/or any hydrocracking catalyst present in a stage. This can allow the dewaxing to occur on molecules that have already been hydrotreated or hydrocracked to remove a significant fraction of organic sulfur- and nitrogen-containing species. The dewaxing catalyst can be located in the same reactor as at least a portion of the hydrocracking catalyst in a stage. Alternatively, the effluent from a reactor containing hydrocracking catalyst, possibly after a gas-liquid separation, can be fed into a separate stage or reactor containing the dewaxing catalyst.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta. ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the disclosure are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

In various embodiments, the catalysts according to the disclosure further include a metal hydrogenation component. The metal hydrogenation component is typically a Group VI and/or a Group VIII metal. Preferably, the metal hydrogenation component is a Group VIII noble metal. Preferably, the metal hydrogenation component is Pt. Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the disclosure can also include a binder. In some embodiments, the dewaxing catalysts used in process according to the disclosure are formulated using a low surface area binder, a low surface area binder represents a binder with a surface area of 100 $m^2/g$ or less, or 80 $m^2/g$ or less, or 70 $m^2/g$ or less.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone can include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B). In still other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B).

It is noted that the general conditions for a dewaxing stage include the conditions mentioned above for the first catalyst bed of an aromatic saturation process according to the disclosure. Similarly, some types of dewaxing catalysts correspond to catalysts suitable for use as a catalyst in a first bed of an aromatic saturation process. In an alternative embodiment, the first catalyst bed of an aromatic saturation process can correspond to the final catalyst bed or stage of a prior process.

Examples of Processing Configurations

FIG. 1 shows an example of a reactor suitable for performing an aromatic saturation process according to the disclosure. In FIG. 1, reactor 100 includes three catalyst beds 110, 120, and 130. Of course, in other embodiments, a catalyst bed 110, 120, or 130 shown in FIG. 1 can represent a plurality of beds if desired. Catalyst bed 110 represents a bed for performing saturation of single ring aromatics. As an example, a suitable dewaxing catalyst (such as one that operates primarily by isomerization) can be used at a reaction temperature of 320° C. The hydrogen partial pressure in the reactor can be from 2.4 MPag to 6.9 MPag, such as at least 2.4 MPag or 6 MPag or less.

Catalyst bed 120 represents a second catalyst bed suitable for some additional saturation of single ring aromatics and some reduction of multi-ring aromatics. As described above, examples of suitable catalysts in the second catalyst bed include dewaxing catalysts that operate primarily by isomerization or MCM-41 type catalysts. The temperature in the second bed can be, for example, 280° C. The third catalyst bed 130 represents a catalyst bed suitable for reducing the amount of multi-ring aromatics. MCM-41 type catalysts are suitable for use in catalyst bed 130. The temperature in the third bed can be, for example, 240° C.

During operation, an input feed 105 can be introduced into reactor 100. The input feed is successively exposed to the catalysts in catalyst beds 110, 120, and 130 in the presence of hydrogen. Hydrogen can be introduced with the input feed 105 or as a separate hydrogen feed 107. Hydrogen can optionally be introduced as a quench gas as part of quench gas streams 115 and 125. Quench gas streams 115 and 125 assist in controlling the temperature desired for processing in catalyst beds 120 and 130. Exposing the input feed 105 to the catalyst beds 110, 120, and 130 results in an effluent 133 with a reduced aromatic content.

Figure 2:
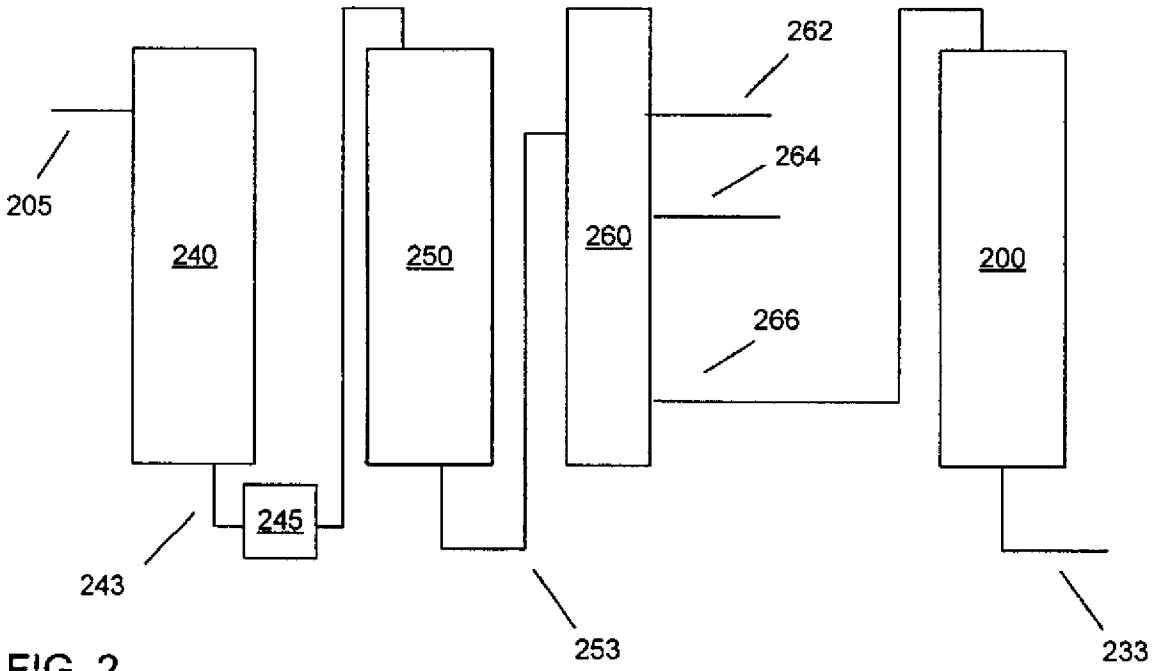
FIG. 2 schematically shows a reaction system incorporating an aromatic saturation process.

FIG. 2 shows an example of an aromatic saturation reactor 200 as part of a larger reaction system, such as a fuels hydrocracking reaction system. In FIG. 2, a feedstock 205 is introduced into a hydrotreatment reactor 240 to remove sulfur and nitrogen contaminants from the feedstock. The effluent 243 from reactor 240 is separated in a gas-liquid separator 245.

The liquid effluent 253 is then passed into a hydrocracking reactor 250. The effluent from hydrocracking reactor 250 is then fractionated in fractionator 260. Fractionator 260 generates one or more fuels cuts, such as a naphtha cut 262 and a diesel cut 264. A bottom cut 266 is also generated and fed into aromatic saturation reactor 200. The effluent 233 from aromatic saturation reactor 200 is suitable for use as a Group I or Group II lubricant base oil, depending on the conditions in reactor 200.

Figure 3:
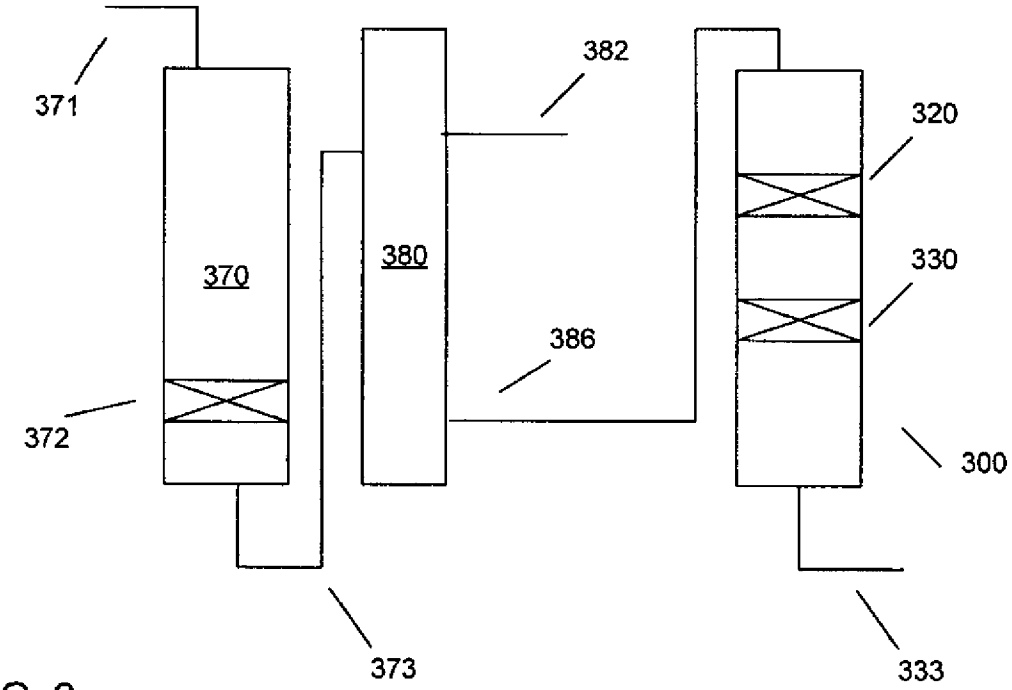
FIG. 3 schematically shows an alternative configuration for incorporating an aromatic saturation process.

FIG. 3 shows another possible configuration for performing an aromatic saturation process. In the example shown in FIG. 3, a hydroprocessing reactor 370 is shown that includes one or more types of catalyst beds and that receives an optionally previously hydroprocessed feedstock 371. At least the bottom catalyst bed 372 of hydroprocessing reactor 370 corresponds to a bed of a dewaxing catalyst that operates primarily by isomerization. In the configuration shown in FIG. 3, catalyst bed 370 is operated under conditions corresponding to the first aromatic saturation stage according to the disclosure, including using a dewaxing catalyst suitable for a first bed for aromatic saturation. The effluent 373 from reactor 370 is then fractionated 380 to generate various cuts or fractions, such as fraction 382 and fraction 386. In FIG. 3, fraction 386 is used as the input to reactor 300, where the remaining catalyst beds 320 and 330 for the aromatic saturation process are located. The effluent 333 from aromatic saturation reactor 300 is suitable for use as a Group I or Group II lubricant base oil, depending on the conditions in reactor 300.

EXAMPLES

Example 1

Initial Aromatic Saturation Bed

The following example describes processing that corresponds to processing of a first bed or stage of an aromatic saturation process. Also described here is a comparative process not according to the disclosure.

A fuels hydrocracking process was used to process a feed boiling in the vacuum gas oil boiling range. The final stage of the fuels hydrocracking process was a stage where the hydroprocessed feed was exposed to a dewaxing catalyst. In one configuration, the dewaxing catalyst included 0.6 wt % Pt on an alumina bound ZSM-48 catalyst. The silica to alumina ratio of the ZSM-48 was between 110:1 and 200:1. ZSM-48 is a dewaxing catalyst that operates primarily by isomerization. The feed was exposed to the dewaxing catalyst at a temperature of 320° C. and a hydrogen partial pressure of 2.8 MPag (400 psig). In a comparative configuration, the dewaxing catalyst included 0.6 wt % Pt on alumina bound zeolite Beta. Zeolite Beta is a dewaxing catalyst where a substantial portion of the dewaxing activity is due to cracking. The feed was exposed to the zeolite Beta under conditions to generate a comparable yield of liquid product in a boiling range suitable for making lubricating oil basestock. The hydroprocessing in the presence of a ZSM-48 dewaxing catalyst generated an effluent with a mutagenicity index of 0.5, a total aromatics content of 566 mol/g, a viscosity index of 118, and a pour point of −22° C. By contrast, hydroprocessing in the presence of the zeolite Beta generated an effluent with a mutagenicity index of 2.4, a total aromatics content of 1154 μmol/g, a viscosity index of 96, and a pour point of −33° C. The total aromatics content for the samples was estimated by correlation, according to method B3997/PGC. The mutagenicity index was estimated based on the absorption of a sample at 325 nm. Based on the pour point, it would appear that the hydroprocessing conditions in the presence of the zeolite Beta were more severe than the processing conditions in the presence of the ZSM-48 catalyst. In spite of this, the feed processed in the presence of the ZSM-48 catalyst corresponds to a more suitable initial stage for producing a lubricant base oil with reduced aromatic content. Without the first aromatic saturation bed, or with a catalyst not according to the disclosure such as zeolite Beta, the total aromatics concentration will be higher when the feed reaches the second and third aromatic saturation beds or stages.

Example 2

Second and Third Aromatic Saturation Beds

A feed comparable to the effluent from processing with a ZSM-48 dewaxing catalyst as described in Example 1 was used as an input feed for aromatic saturation processes at various conditions. As described above, the input feed had an initial aromatics content of 566 mmol/g. The amount of aromatics with two or more rings was 204 μmol/g.

Figure 4:
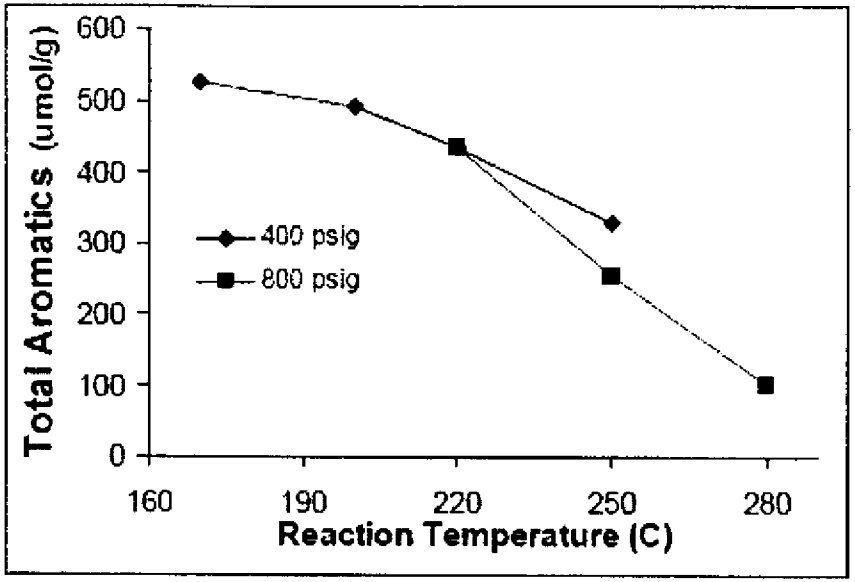
FIG. 4 shows results corresponding to a portion of an aromatic saturation process.

FIG. 4 shows the total aromatic content of samples after additional aromatic saturation. Once again, total aromatic content was estimated by correlation, according to method B3997/PGC. FIG. 4 shows results from processing of a feed over an MCM-41 catalyst that is supporting 0.3 wt % Pt and 0.9 wt % Pd as hydrogenation metals. The results show processing at various temperatures at both 2.8 MPag (400 psig) and 5.5 MPag (800 psig). As shown in FIG. 4, the processing at both 2.8 MPag and 5.5 MPag results in total aromatics content above 400 μmol/g for processing temperatures of 220° C. or less. At 250° C. and higher, the total aromatics content is reduced to a level near 300 μmol/g. At 250° C. and 5.5 MPag (800 psig), the total aromatics content is reduced to 100 μmol/g. An aromatics content of 100 μmol/g will typically correspond to less than 3 wt % aromatics, which is required for a lubricant base oil to qualify as a Group II lubricant base oil.

Figure 5:
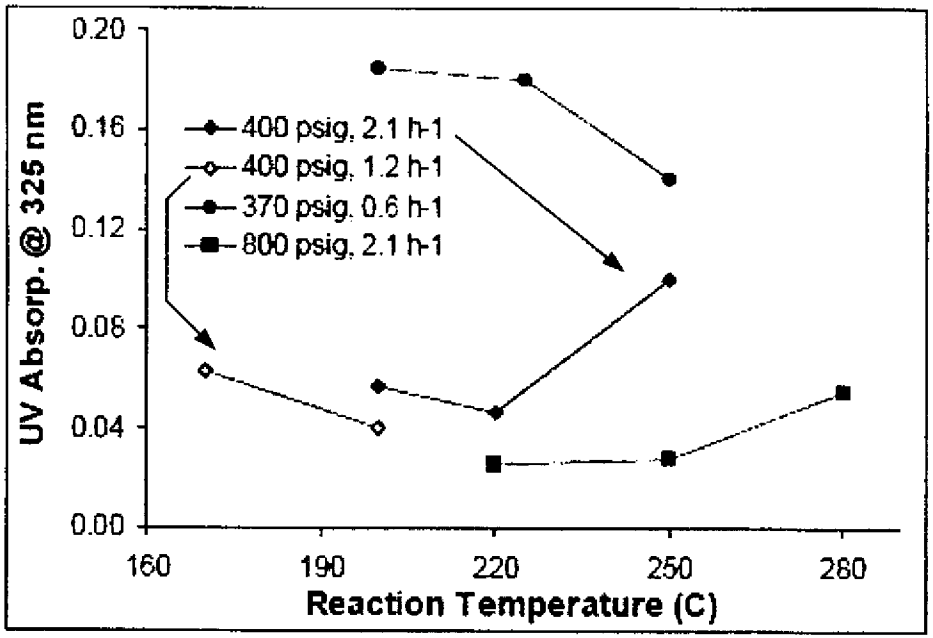
FIG. 5 shows results corresponding to a portion of an aromatic saturation process.

While increasing the temperature during processing results in a lower total aromatics content, temperature increases do not necessarily lead to a decrease in mutagenicity index. The UV absorptivity of a sample at 325 nm provides a rough guide for the mutagenicity index. FIG. 5 shows the UV absorption at 325 nm for the two aromatics saturation processes in FIG. 4, as well as another process at 400 psig, but a lower space velocity. (For the two lines in the plot corresponding to the 400 psig processes, arrows are used to associate the symbols with the appropriate results.) Additionally, FIG. 5 shows the UV absorption at 325 nm for a feed where a ZSM-48 dewaxing catalyst was used for the aromatic saturation, instead of the MCM-41 catalyst. The ZSM-48 dewaxing catalyst included 0.6 wt % of Pt as a hydrogenation metal. For comparison, the absorption at 325 nm for the feed was 0.58. As shown in FIG. 5, a minimum in absorption at 325 nm is shown somewhere between 220° C. and 250° C. depending on the processing pressure, for the MCM-41 type catalysts. FIG. 5 also shows that increasing the temperature to 280° C. leads to an increase in absorptivity for the MCM-41 type catalysts. The ZSM-48 dewaxing catalyst shows a much higher absorptivity at all temperatures shown in FIG. 5.

The combination of FIG. 4 and FIG. 5 illustrates the benefit of the claimed disclosure. An aromatic saturation process that involves processing at only one temperature will lead to one of two less desirable results. At a higher processing temperature, such as 280° C., the total aromatics content is reduced to a lower level as shown in FIG. 4, but the mutagenicity index will be higher, as shown in FIG. 5. By contrast, processing only at a lower temperature such as 240° C. will result in a lower mutagenicity index, but a higher total aromatics content. By using two beds (or stages) of aromatic saturation catalyst according to the disclosure, the total aromatics content can first be reduced to a desired level, followed by reducing the mutagenicity index.

Additional Embodiments and PCT/EP Clauses

Embodiment 1

A method for producing a lubricant base oil, comprising: contacting an input feed having an aromatics content of at least 600 mmol/kg with a first catalyst under first effective aromatic saturation conditions to produce a first effluent containing less than 600 mmol/kg of aromatics, the first effective aromatic saturation conditions including a temperature of at least 300° C.; contacting the first effluent with a second catalyst under second effective aromatic saturation conditions to produce a second effluent, the second effective aromatic saturation conditions including a temperature of from 270° C. to 300° C. and a hydrogen partial pressure of at least 4.1 MPag (600 psig); and contacting the second effluent with a third catalyst under third effective aromatic saturation conditions, the third effective aromatic saturation conditions including a temperature of from 220° C. to 260° C.

Embodiment 2

The method of embodiment 1, wherein the first catalyst comprises a dewaxing catalyst that operates primarily by isomerization.

Embodiment 3

A method for producing a lubricant base oil, comprising: hydrocracking a feedstock having a T5 boiling point of at least 550° C. under effective hydrocracking conditions to form a hydrocracked feedstock having an aromatics content of at least 200 mmol/kg; fractionating the hydrocracked feedstock to form at least a diesel fraction and a fraction having a higher boiling range than the diesel fraction; contacting the higher boiling range fraction with a dewaxing catalyst that operates primarily by isomerization under first effective aromatic saturation conditions to produce a first effluent containing a lower amount of aromatic than the hydrocracked feedstock, the first effective aromatic saturation conditions including a temperature of at last 300° C.; contacting the first effluent with a second catalyst under second effective aromatic saturation conditions to produce a second effluent, the second effective aromatic saturation conditions including a temperature of from 270° C. to 300° C. and a hydrogen partial pressure of at least 4.1 MPag (600 psig); and contacting the second effluent with a third catalyst under third effective aromatic saturation conditions, the third effective aromatic saturation conditions including a temperature of from 220° C. to 260° C.

Embodiment 4

The method of any of embodiments 1-3, wherein the first catalyst comprises ZSM-48, ZSM-23, or a combination of ZSM-48 and ZSM-23, a binder, and from 0.1 wt % to 1.5 wt % of Pt supported on the catalyst.

Embodiment 5

The method of any of embodiments 1-4, wherein the second catalyst comprises MCM-41, ZSM-48, ZSM-23, or a combination of ZSM-48 and ZSM-23, a binder, and from 0.1 wt % to 1.5 wt % of Pt, Pd, or a combination of Pt and Pd.

Embodiment 6

The method of any of embodiments 1-5, wherein the third catalyst comprises MCM-41, a binder, and from 0.1 wt % to 1.5 wt % of Pt, Pd, or a combination of Pt and Pd.

Embodiment 7

A method for producing a lubricant base oil, comprising: contacting an input feed having an aromatics content of at least 200 mmol/kg, preferably at least 600 mmol/kg, and a mutagenicity index of at least 1.0 with a first catalyst under first effective aromatic saturation conditions to produce a first effluent containing a lower amount of aromatics than the input feed prior to contacting, the first catalyst comprising from 0.1 wt % to 1.5 wt % Pt on a support including a binder and ZSM-48, ZSM-23, or a combination of ZSM-48 and ZSM-23, the first effective aromatic saturation conditions including a temperature of at last 300° C.; contacting the first effluent with a second catalyst under second effective aromatic saturation conditions to produce a second effluent, the second catalyst comprising from 0.1 to 1.5 wt % of a metal selected from Pt, Pd, or a combination of Pt and Pd, a binder, and MCM-41, ZSM-48, ZSM-23, or a combination of ZSM-48 and ZSM-23, the second effective aromatic saturation conditions including a temperature of from 270° C. to 300° C. and a hydrogen partial pressure of at least 2.4 MPag (400 psig); and contacting the second effluent with a third catalyst under third effective aromatic saturation conditions, the third catalyst comprising from 0.1 to 1.5 wt % of a metal selected from Pt, Pd, or a combination of Pt and Pd, a binder, and MCM-41, the third effective aromatic saturation conditions including a temperature of from 220° C. to 260° C.

Embodiment 8

The method of any of embodiments 1-7, wherein the first catalyst and the second catalyst are the same.

Embodiment 9

The method of any of embodiments 1-8, wherein the input feed comprises at least 2000 mmol/kg of aromatics.

Embodiment 10

The method of any of embodiments 1-9, wherein the second effective aromatic saturation conditions include a hydrogen partial pressure of at least 5.2 MPag (750 psig).

Embodiment 11

The method of any of embodiments 1-10, further comprising quenching the first effluent using a gas phase quench stream containing hydrogen.

Embodiment 12

The method of any of embodiments 1-11, wherein the second catalyst and the third catalyst are the same.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for producing a lubricant base oil, comprising:

hydrocracking a feedstock having a T5 boiling point of at least 550° C. under effective hydrocracking conditions to form a hydrocracked feedstock having an aromatics content of at least 200 mmol/kg;

fractionating the hydrocracked feedstock to form at least a diesel fraction and a fraction having a higher boiling range than the diesel fraction;

contacting the higher boiling range fraction with a dewaxing catalyst that operates primarily by isomerization under first effective aromatic saturation conditions to produce a first effluent containing a lower amount of aromatic than the hydrocracked feedstock, the first effective aromatic saturation conditions including a temperature of at last 300° C.;

contacting the first effluent with a second catalyst under second effective aromatic saturation conditions to produce a second effluent, the second effective aromatic saturation conditions including a temperature of from 270° C. to 300° C. and a hydrogen partial pressure of at least 4.1 MPag (600 psig); and contacting the second effluent with a third catalyst under third effective aromatic saturation conditions, the third effective aromatic saturation conditions including a temperature of from 220° C. to 260° C.

2. The method of claim 1, wherein the first catalyst comprises ZSM-48, ZSM-23, or a combination of ZSM-48 and ZSM-23, a binder, and from 0.1 wt % to 1.5 wt % of Pt supported on the catalyst.

3. The method of claim 1, wherein the second catalyst comprises MCM-41, ZSM-48, ZSM-23, or a combination of ZSM-48 and ZSM-23, a binder, and from 0.1 wt % to 1.5 wt % of Pt, Pd, or a combination of Pt and Pd.

4. The method of claim 1, wherein the third catalyst comprises MCM-41, a binder, and from 0.1 wt % to 1.5 wt % of Pt, Pd, or a combination of Pt and Pd.

5. A method for producing a lubricant base oil, comprising:

contacting an input feed having an aromatics content of at least 200 mmol/kg, and a mutagenicity index of at least 1.0 with a first catalyst under first effective aromatic saturation conditions to produce a first effluent containing a lower amount of aromatics than the input feed prior to contacting, the first catalyst comprising from 0.1 wt % to 1.5 wt % Pt on a support including a binder and ZSM-48, ZSM-23, or a combination of ZSM-48 and ZSM-23, the first effective aromatic saturation conditions including a temperature of at last 300° C.;

contacting the first effluent with a second catalyst under second effective aromatic saturation conditions to produce a second effluent, the second catalyst comprising from 0.1 to 1.5 wt % of a metal selected from Pt, Pd, or a combination of Pt and Pd, a binder, and MCM-41, ZSM-48, ZSM-23, or a combination of ZSM-48 and ZSM-23, the second effective aromatic saturation conditions including a temperature of from 270° C. to 300° C. and a hydrogen partial pressure of at least 2.4 MPag (400 psig); and contacting the second effluent with a third catalyst under third effective aromatic saturation conditions, the third catalyst comprising from 0.1 to 1.5 wt % of a metal selected from Pt, Pd, or a combination of Pt and Pd, a binder, and MCM-41, the third effective aromatic saturation conditions including a temperature of from 220° C. to 260° C., and wherein the second catalyst and the third catalyst are the same.

6. The method claim 5, wherein the first catalyst and the second catalyst are the same.

7. The method of claim 5, wherein the input feed comprises at least 2000 mmol/kg of aromatics.

8. The method of claim 5, wherein the second effective aromatic saturation conditions include a hydrogen partial pressure of at least 5.2 MPag (750 psig).

9. The method of claim 5, further comprising quenching the first effluent using a gas phase quench stream containing hydrogen.

* * * * *